United States Patent [19]

Pariza

[11] 4,097,861

[45] Jun. 27, 1978

[54] D.C. HORN

[75] Inventor: George R. Pariza, Schaumburg, Ill.

[73] Assignee: Pittway Corporation, Northbrook, Ill.

[21] Appl. No.: 776,952

[22] Filed: Mar. 14, 1977

[51] Int. Cl.[2] ..... G10K 9/12

[52] U.S. Cl. ..... 340/388; 340/392; 340/402

[58] Field of Search ..... 340/388, 392, 402, 384 E, 340/400

[56] References Cited

U.S. PATENT DOCUMENTS

| | | | |
|---|---|---|---|
| 2,784,399 | 3/1957 | Smith | 340/388 X |
| 2,896,202 | 7/1959 | Bonanno | 340/388 |
| 3,345,627 | 10/1967 | Herst | 340/388 |
| 3,950,744 | 4/1976 | Stephens | 340/388 X |

*Primary Examiner*—Harold I. Pitts
*Attorney, Agent, or Firm*—Gary, Juettner & Pyle

[57] ABSTRACT

A horn of improved, compact and efficient construction, formed of minimum numbers of components, is characterized by integrally formed parts which facilitate assembly of the horn and which increase the magnetic flux generated by the horn and the efficiency thereof, establish circuit paths within the horn without the need for separate conductors, and present terminals exteriorly of the horn for being connected with circuitry for operating the horn.

The horn includes a housing having an open end and relatively imperforate wall areas, a bracket of magnetically permeable material supporting an electromagnetic coil within the housing, a diaphragm positioned over and closing the open end, a striker of magnetically permeable material connected with the bracket and operatively associated with the coil for repetitively striking the diaphragm to generate noise, and a cover having a sound directing port positioned over the diaphragm. The striker is normally urged against the diaphragm, and the bracket has portions which extend from one pole of the coil to a position adjacent the other pole for generating thereat a strong field of magnetic flux for attracting the striker away from the diaphragm. A pair of coil terminals and a terminal connected with the striker extend exteriorly of the housing, and the horn is mountable on a substrate having circuitry for connecting with the terminals and housing and for selectively applying a d.c. voltage thereto to operate the horn.

10 Claims, 5 Drawing Figures

118
116
114
112
108
106
110
52
50
104
54
62a
46
40
94
96
62b
64b
56
92
84
80
70a
72a
72
86
68
70c
42
66
44
90
90
74
78
70b
74a
100
102
98
30
28
36a
22
36b
38
36c
20

D.C. HORN

BACKGROUND OF THE INVENTION

The present invention relates to horns for generating an audible signal or alarm.

By way of example, fire detectors for sensing smoke or the products of combustion include a horn to sound an audible alarm so a fire will not go undetected for lack of immediate visual supervision, and so all personnel within hearing range of the alarm will be alerted to the danger. Such audible alarm is essential in environments such as homes, where immediate supervision customarily is lacking while the occupants are asleep.

It is not only desirable, but necessary, that the audible alarm generating horn be both efficient, to generate a very loud alarm, and reliable, to generate and continue generating an alarm every time and for as long as power is supplied to it. Therefore, horns of the general type should ideally be configured to maximize the sound level of the alarm generated thereby, and be designed to assure reliability.

In addition, the horns must be of small size because they customarily are confined within a small space, for example a relatively small household appliance such as a fire detector to be mounted on the wall or on the ceiling in a home, and they must also be of very economical construction to avoid pricing the appliance outside the economic reach of the general consumer.

In my copending application Ser. No. 765,049, filed Feb. 2, 1977, there is disclosed a very loud, efficient and economical horn of the foregoing type, which is a.c. voltage powered and particularly suited for use as an audible alarm or sound generator within a fire detector. In situations where a source of a.c. voltage is not conveniently available to power a fire detector, detectors having a self-contained source of power, such as a battery, ordinarily are provided. Such detectors require a d.c. voltage powered horn to generate the audible alarm, which horn likewise should be economical and of small size, and in particular should be efficient in order to generate a very loud alarm with minimum power consumption in order that the alarm will be generated for a very long time before the battery is depleted.

OBJECTS OF THE INVENTION

An object of the present invention to provide an improved d.c. voltage powered horn which is of small size, economical construction and great reliability, is efficient in its operation, and maximizes the intensity of sound generated thereby.

Another object of the invention to provide such a horn embodying a minimum number of component parts, thereby to reduce the cost and increase the reliability of the horn and to facilitate the assembly thereof.

A further object of the invention is to provide such a horn wherein the components themselves establish electrical paths without the need for separate conductors, and wherein terminals are brought to the exterior of the horn for being connected with circuitry for operating the horn.

SUMMARY OF THE INVENTION

In accordance with the present invention, a horn of improved and economical construction, formed of minimum numbers of components, is characterized by integrally formed component parts interconnected to establish electrical operating paths within the horn itself and to present exteriorly of the horn terminals for being connected with circuitry for operating the horn.

The horn includes a housing formed of electrically conductive material and having walls the margins of which define an opening, an electromagnetic coil within the housing and having a pair of terminals extended exteriorly of the housing, a diaphragm of electrically conductive material positioned on the housing in electrical contact therewith over the opening and closing the housing, and a striker of magnetically permeable and electrically conductive material. The striker is mounted in the housing between the diaphragm and the coil in operative association with the coil for movement away from and strikingly against the diaphragm to generate noise, and is resiliently urged toward and into electrical contact with the diaphragm. The striker is insulated from direct electrical contact with the housing and coil terminals, and a terminal extended exteriorly of the housing is electrically connected with the striker.

The coil has two magnetic poles, and the striker is mounted to be between the diaphragm and one of the poles. To maximize the field of magnetic flux at the one pole to readily draw the striker theretoward to then be released for striking engagement with the diaphragm, a magnetically permeable path is provided to direct the magnetic flux at the other pole face to a position closely spaced from the one pole, whereby a relatively dense and expanding magnetic field of flux is generated thereat.

A frustrum-conical shaped cover is positioned over the diaphragm and has a sound exit port formed therethrough, whereby noise generated by the impact of the striker against the diaphragm is effeciently directed out of the port to maximize the noise generated by the horn. The horn is readily adapted to be mounted on a substrate having circuitry for selectively interconnecting and providing power to the terminals extended exteriorly of the housing, whereby the horn may readily, efficiently and economically form a component of an appliance, such as a fire detector. Further, the reliability of the horn is increased by the elimination of internal soldered electrical connections which are subject to destruction by the vibratory forces incident to operation of the horn.

The above stated objects of the invention are thus attained with particular facility and economy. Other objects, advantages and features of the invention will become apparent from the following detailed description when taken in conjunction with the accompanying drawings.

DETAILED DESCRIPTION

Figure 2:
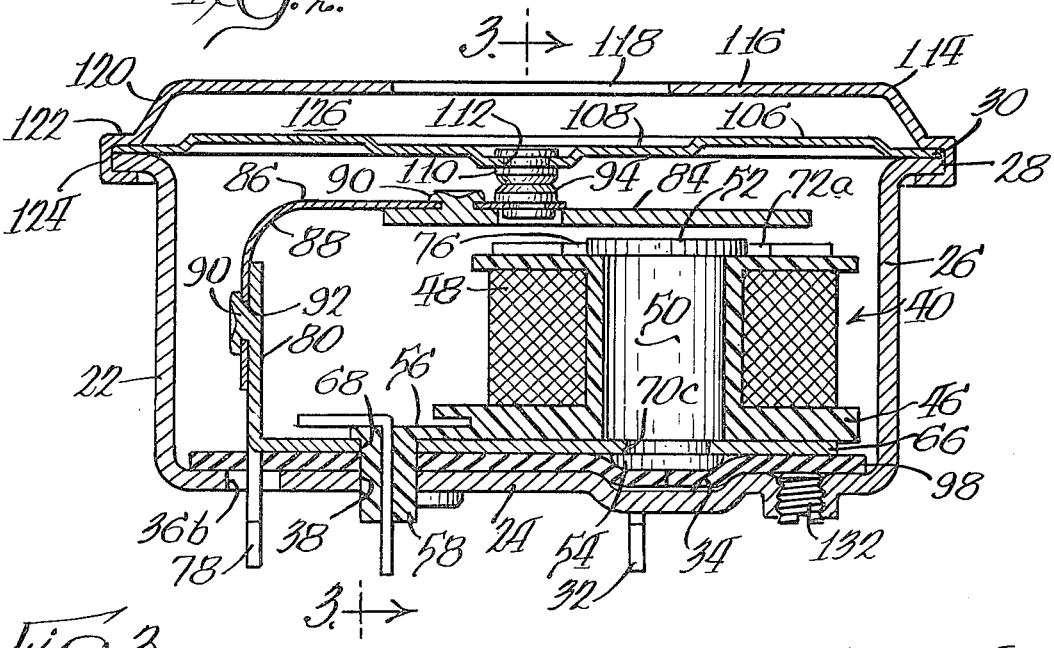
FIG. 2 is a vertical sectional view of the horn, taken substantially along the lines 2—2 of FIG. 1.
Figure 3:
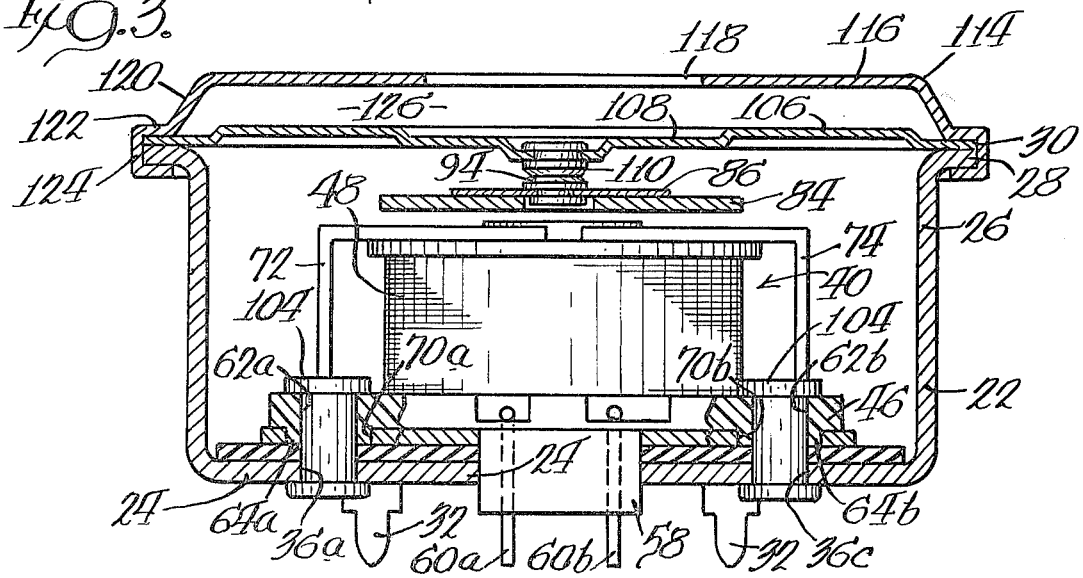
FIG. 3 is a vertical sectional view of the horn, taken substantially along the lines 3—3 of FIG. 2.
Figure 5:
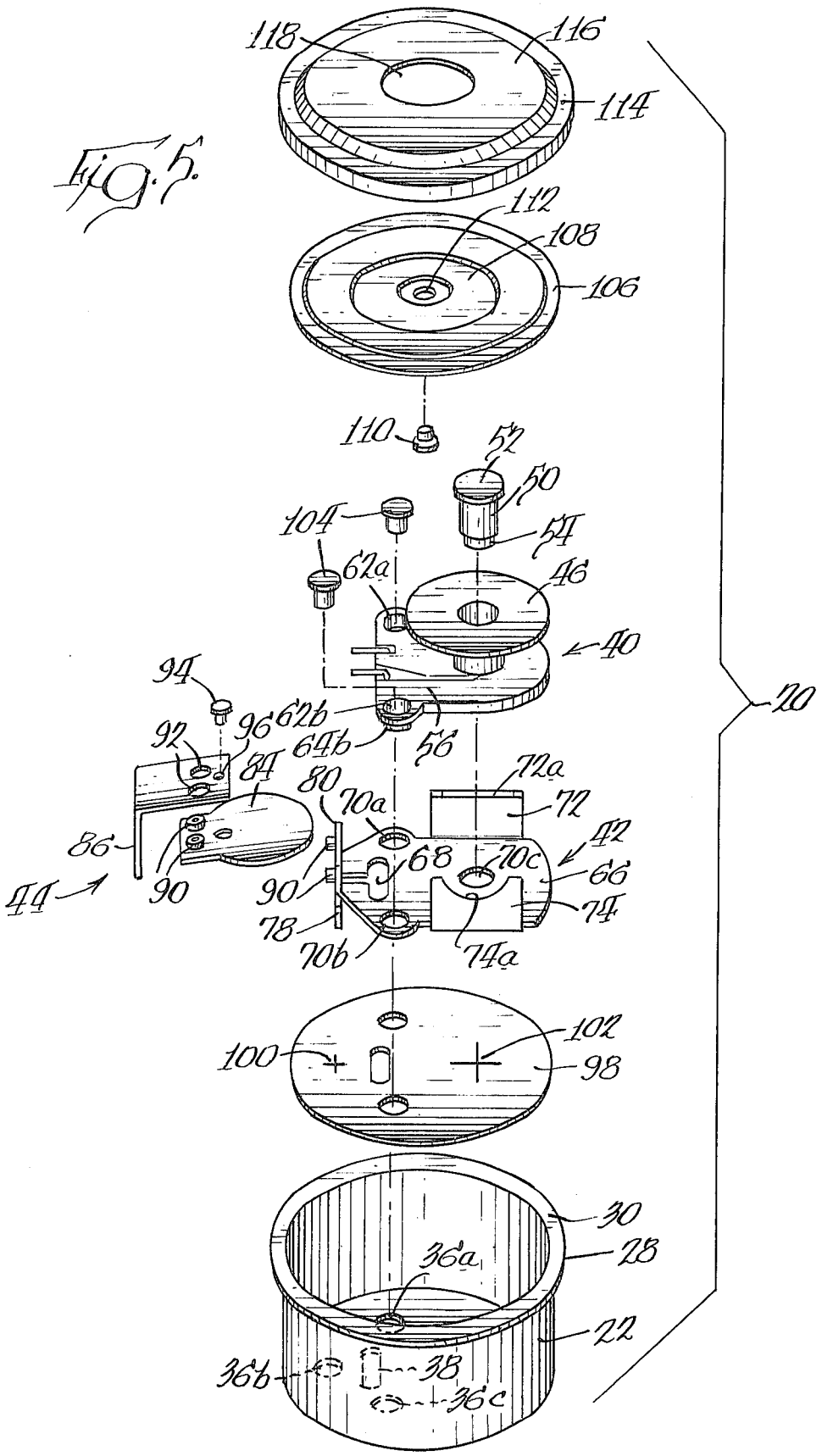
FIG. 5 is an exploded, perspective, assembly view showing all of the components of the horn and illustrating the paucity of the components and the simplicity of assembly thereof.

The drawings illustrate an electrically operated horn, indicated generally at 20, embodying the principle of the present invention. The horn may be used as a d.c. voltage or battery powered audible alarm where such alarms are required, but because of its compact and efficient structure is particularly suited for use as an audible alarm or sound generator within a fire detector (not shown). With particular reference to FIGS. 2, 3 and 5, the horn includes an integrally formed, generally cup-shaped housing 22 having relatively imperforate walls. The housing is formed of an electrically conductive material, such as metal, and has a circular, generally planar base 24, a cylindrical wall section 26 extending perpendicularly upward from the circumference of the base, and an annular flange or lip 28 having an upper surface 30 defining a shelf extending radially outward from the upper end of the section 26. The base 24 has a pair of tabs or terminals 32 formed therewith and extending downwardly therefrom, and a circular recessed area 34. The base also has three circular openings 36*a–c* and an elongated opening 38.

An electromagnetic coil and bobbin assembly, a bracket for the coil, and a striker and spring assembly, indicated generally at 40, 42 and 44, respectively, are arranged to efficiently be interconnected and mounted in the housing without the need for conventional fasteners. The electromagnetic coil and bobbin assembly 40 is for generating a field of magnetic flux to operate the horn, and includes an integrally formed bobbin 46 of an insulating material having a plurality of windings 48 of an insulated conductor and a core 50 of a magnetically permeable material. The core has an upper magnetic pole face 52 and a lower magnetic pole defined by a stud portion 54. A lower shelf 56 of the bobbin is formed with a downwardly extending elongate section 58 having a pair of passages therethrough for receiving a pair of L-shaped wires or terminals 60*a* and 60*b*, with lower ends of the terminals extending beyond the lower end of the section. The terminals are connected at upper ends with opposite ends of the windings 48, whereby a voltage applied to the terminals is applied across the coil to generate a field of magnetic flux. A pair of passages 62*a* and 62*b* through the shelf each have therearound a shoulder 64*a* or 64*b* formed integrally with the bobbin. The upper bent over portions of the terminals are nestled within channels in the shelf 56 and below the surface thereof, thereby providing an unobstructed path to the center spool portion of the bobbin so that the same may very economicaly be manufactured by directly machine winding the insulated conductor thereon. This eliminates separately fabricating the bobbin and coil for later assembly, as is conventional.

The bracket 42 for the coil is integrally formed of an electrically conductive, magnetically permeable material, such as steel, and includes a generally planar base 66 having an elongated opening 68 and three circular openings 70*a–c* therethrough. The coil is supported on the bracket with the stud 54 of the core 50 extended through the opening 70*c*, with the section 58 extended through the opening 68, and with the bobbin shoulders 64*a* and 64*b* within the openings 70*a* and 70*b*, and is secured thereto by staking or rolling the stud over the lower surface of the base. By staking the stud, the need for fastners to secure the coil to the bracket is eliminated, thereby minimizing the number of components in the horn and simplifying the design thereof. The bracket also includes a pair of L-shaped flux directing arms 72 and 74 on opposite sides of the base, which initially are formed to extend outwardly of the base of facilitate mounting of the coil thereon. The upper ends of the arms are provided with semi-circular openings 72*a* and 74*a*, whereby after mounting the coil and bobbin to the base the arms are inwardly bendable around the coil to surround the upper magnetic pole face 52 of the core within the openings 72*a* and 74*a* and to define an air gap 76 therebetween. With the base of the bracket connected and magnetically linked with one magnetic pole of the coil by means of the stud 54, the arms effectively and efficiently provide a magnetically permeable path for the flux thereat to generate across the air gap a relatively high density and expanding field of magnetic flux to strongly attract and reliably operate the striker of the horn, as will be described. To facilitate inward bending of the arms, the same are preferably scored along the line whereat they join the base. For mounting the spring and striker assembly to the bracket, and for connecting the bracket with a source of voltage, as will be described, the bracket also includes an upright end portion having a downwardly extending terminal 78 and an upwardly extending plate 80.

The spring and striker assembly 44 includes a generally planar and circular striker 84 of an electrically conductive and magnetically permeable material supported above and in a spaced relationship from the pole face 52 by a leaf spring 86, also of an electrically conductive material, extended between the striker and the bracket 42 and bent along a radius 88. While the spring may be secured to the striker and bracket with conventional fasteners, such as screws, in a preferred manufacturing method which further minimizes the number of components the spring is spot welded to the striker and bracket, or is secured thereto as by nubs 90 extended through and staked over passages 92 in the spring. An electrical striker contact 94 of tungsten or other suitable material is extended through a passage 96 in the spring and secured thereto by staking, with an enlarged and aligned passage 98 in the striker both providing access to the contact during the staking operation and accommodating the staked portion therein. In the operation of the horn the striker 84 alternately is attracted to and moved toward the pole face 52 by the coil 40, and then away from the pole face by the spring 86.

The coil and striker assembly is positioned within the housing and mounted to the base 24 with an insulator 98 positioned between the bracket and the base. The insulator may be of any suitable material having electrical insulating characteristics, such as Mylar, and is circular in shape and of a diameter corresponding to the diameter of the base. The insulator is formed with a pair of circular passages and an elongated passage alignable with the passages 36*a*, 36*c* and 38 in the base 24, and is provided with a first set of crossed slits 100 alignable with the passage 36*b* and second set of crossed slits 102 alignable with the recessed area 34 when the insulator is positioned on the base. With the insulator on the base, the coil and striker assembly is placed in the housing to extend the section 58 and the terminals 60*a* and 60*b* through the elongated slot 38, to extend the bracket terminal 78 through the insulator slits 100 and the passage 36*b*, and to nestle the staked stud 54 within the recessed area 34 with the slits 102 then slightly parting to freely allow entry of the stud therein. A pair of metal rivets 104 are then extended through the aligned passages 62*a* and 36*a* and the passages 62*b* and 36*c*, and are staked or rolled over the base of the housing to firmly secure the coil and striker assembly therein. By utilizing rivets as compared with conventional fasteners, the number of components in the horn is yet further reduced and the design thereof additionally simplified.

It should be noted that the insulator 98 forms an electrically insulating layer between the bracket and the base of the housing, and that the shoulders 64*a* and 64*b* prevent an electrical connection between the bracket and the housing through the rivets 104, whereby the bracket is completely electrically insulated from the housing. It is also to be appreciated that by means of the shoulders 64*a* and 64*b*, formed integrally with the bobbin, the need for separate sleeve type insulators for the rivets is eliminated, additionally minimizing the number of components in the horn and simplifying the manufacture thereof. Further, as thus far assembled the rivets close the housing passages 36*a* and 36*c*, the terminal section 58 closes the passage 38, and because of the slits 100 formed in the bobbin the passage 36*b* is substantially closed, whereby the wall areas of the housing are essentially imperforate so that in the operation of the horn the noise generated thereby is maximized.

A circular sound disc or diaphragm 106 of a relatively flexible and electrically conductive material, such as metal, having a diameter approximately equal to the outer diameter of the housing lip 28, is circumferentially supported on the surface 30 of the lip. The diaphragm is formed with a downwardly displaced central area 108 and has an electrical contact 110 of tungsten or other suitable material fastened by staking within a passage 112 formed therethrough. The contact 110 is positioned directly above the contact 94, and to this end it should be noted that the spring 86 in maintaining the striker above the pole face 52 normally urges the contact 94 against and into electrical contact with the contact 110.

The diaphragm is held over the housing and against the surface of the lip 28 by an integral, substantially conical-frustrum shaped cover 114. The cover includes a circular, planar top portion 116 having a circular sound exit port 118 formed in the center thereof. A side wall 120 extends downwardly and outwardly from the circumference of the top portion to an annular lip 122 extending parallel to the top portion and having an outer diameter substantially equal to the outer diameter of the lip 28. A flange 124 extends perpendicularly downward from the lip 122, and the cover is positioned over the diaphragm with the lower surface of the lip 122 resting thereon around and adjacent to the circumference thereof and with the flange 124 extending downwardly past the outer periphery of the lip 28. The flange is then rolled over the lip to fasten the cover to the housing with the diaphram secured therebetween. The cover thus defines with the diaphragm a substantially conical-frustrum shaped sound directing chamber 125 for efficiently directing generated noise toward and through the port 118.

Figure 1:
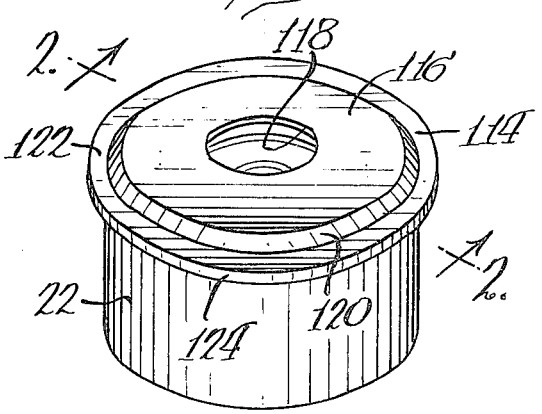
FIG. 1 is a perspective view of a preferred embodiment of the horn of the invention.
Figure 4:
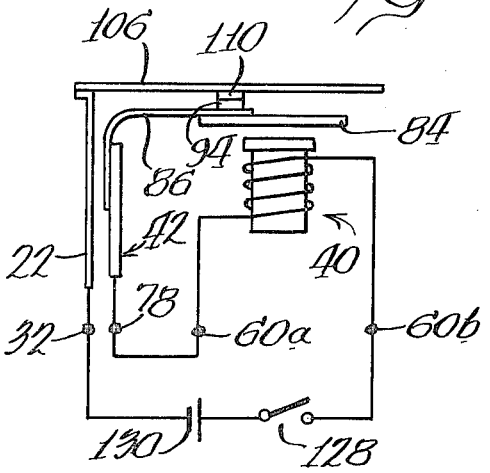
FIG. 4 illustrates, partly in schematic and partly in pictorial form, a circuit for operating the horn, and particularly shows the interconnection of the components of the horn for establishing circuit paths in the horn without the need for separate electrical conductors.

As assembled, an electrical connection is established between the housing tabs 32 and the bracket terminal 78 through the housing 22, the diaphragm 106, the electrically engaging contacts 110 nd 94, the spring 86 and the bracket 42. In the use of the horn with a fire detector, for example, the horn conveniently is mounted on a substrate, for supporting other components of the detector, by extending the housing tabs 32, the bracket terminal 78, and the coil terminals 60*a* and 60*b* through passages in the substrate, and by then folding over or soldering the tabs and terminals to the substrate to secure the horn thereto. With the horn mounted on a substaate or other suitable carrier therefor, means are provided, for example conductors formed on the substrate as represented schematically in FIG. 4, for directly electrically connecting one of the coil terminals with the bracket terminal 78, and for controlling the application of a d.c. voltage across the other coil terminal and one or both tabs 32 of the housing. Where the substrate forms a portion of a battery powered fire detector, the means for controlling the application of the voltage usually includes a switch 128 closable by the detector circuitry upon the occurrence of combustion to connect a battery 130, for powering the detector, across the other coil terminal and a tab of the housing.

The electrical connections with the horn may thus conveniently be established as a part of and during the manufacutre of the substrate circuitry, as during wave soldering of the substrate, whereby the horn may conveniently and economically be manufactured into an appliance. Further, by establishing the electrical connections exteriorly of the horn, the need for separately made electrical connections interiorly of the horn, such as a conductor soldered between one of the coil terminals and the bracket as is conventional, are eliminated. Such internal connections are difficult to implement and tenuous as best due to the vibratory forces of the horn during operation thereof. Thus, by the particular electrical structure of the horn, the cost of manufacture of the horn is reduced and reliability thereof is increased.

Turning now to the operation of the horn to generate an alarm, upon closure of the switch 128 the battery is connected across the coil terminals by being connected directly with one of the terminals, such as the terminal 60*b*, and by being connected with the other terminal through the circuit comprising the housing 22, the diaphragm 106, the contacts 110 and 94, the spring 86, the bracket 42 and the substrate conductor. As a result, an expanding field of relatively high density magnetic flux is generated between the magnetic pole face 52 and the upper ends of the flux directing arms 72 and 74 which magnetically are coupled with the other magnetic pole. The striker 84 of magnetically permeable material lies within the expanding field of flux, and upon the passage of lines of flux therethrough an increasing force is exerted to pull or attract the striker from the diaphragm and toward the pole face 52 and the area of higher flux density. When the force becomes sufficient to move the striker against the urging of the spring 86, movement of the striker away from the diaphragm moves the contact 94 out of electrical engagement with the contact 110, whereupon the circuit therethrough and the voltage across the coil is interrupted. When this occurs, movement of the striker away from the horn momentarily continues as a result of the field of magnetic flux generated by the collapsing field of the coil, whereafter the striker is released for movement of the striker contact 94 toward and impact against the diaphragm contact 110 under the urging of the spring. This again establishes the electrical connection between the contacts, whereupon the above described cycle of operation is repeated.

With each impact of the contact 94 against the diaphragm contact 110, a sharp report or sound is generated for exit externally of the horn directly through the sound exit port 118 and through vibration of the horn surfaces. To conveniently control the starting voltage and frequency of operation of the horn, means are provided, such as a self-tapping screw 132 threadable into the base of the housing, for bending the bracket 42 about the rivets 104 to vary the gap between the pole face 52 of the coil and the striker 84.

In view of the foregoing, it is appreciated that the horn is of compact, efficient, reliable structure, and utilizes minimum numbers of components capable of ready assembly. By the expedients of rivets and staking or spotwelding, the need for conventional fasteners has been eliminated and the structural integrity and reliability of the horn increased. The integrally formed bobbin economically may have windings applied thereon by machine, and itself provides by the shoulders formed therewith insulation between the bracket and the housing, thereby further reducing the cost of manufacturing the horn and the number of components thereof. Also, by means of the flux directing arms formed integrally with the coil bracket, a minimum power input to the coil results in a relatively high density field of magnetic flux efficiently established adjacent the striker for operating the same, thereby maximizing the time for which the horn generates an alarm when used in a battery powered appliance. In the case where the battery powered appliance is a fire detector, extended operating time of the horn is of the utmost importance to increase the probability of personnel being alerted to the danger.

While one embodiment of the invention has been described in detail, it is to be understood that various embodiments and other modifications thereof may be devised by one skilled in the art without departing from the spirit and scope of the invention, as defined by the appended claims.

What is claimed is:

1. An improved horn for generating an audible signal, comprising a housing formed of electrically conductive material having walls he margins of which define an opening; an electromagnetic coil within said housing and having a pair of terminals connected to opposite sides of a winding thereof and extending exteriorly of said housing; a diaphragm of electrically conductive material positioned on said housing in electrical contact therewith over said opening and closing said housing; a striker member of magnetically permeable and electrically conductive material; and means for mounting said striker in said housing between said diaphragm and said coil in operative association with said coil for movement away from and strikingly against said diaphragm to generate noise, said means normally resiliently urging said striker toward and into electrical contact with said diaphragm, electrically insulating said striker from direct electrical contact with said housing and said coil terminals, and including a terminal extended exteriorly of said housing and electrically connected with said striker.

2. An improved horn as in claim 1, a cover, said housing having an outwardly extending lip about said opening, said diaphragm and cover resting on said lip, said housing and cover having interengaging portions securing said cover to said housing with said diaphragm therebetween.

3. An improved horn as in claim 2, said cover having conical-frustrum shaped walls and a port therethrough for the passage of noise generated by said horn.

4. An improved horn as set forth in claim 1, said coil having a pair of magnetic poles, said striker being mounted between said diaphragm and one of said poles, means providing a magnetically permeable path for magnetic flux at the other of said poles to a position closely spaced from said one pole to provide a relatively high density expanding field of magnetic flux thereat to attract said striker away from said diaphragm and toward said one pole when said coil is energized.

5. An improved horn as in claim 1, said means for mounting said striker including a bracket of electrically conductive material mounted in said housing, electric insulator means between said bracket and said housing, and a spring of electrically conductive material extended between said bracket and said striker and normally urging said striker into electrical contact with said diaphragm, said terminal electrically connected with said striker being electrically connected with said bracket.

6. An improved horn as in claim 5, said coil having a pair of magnetic poles and being mounted on said bracket, said striker being between one of said poles and said diaphragm, the other of said poles being magnetically linked with said bracket and said bracket having portions providing a magnetically permeable path for magnetic flux at said other pole to a position closely spaced from said one pole to provide a relatively high density expanding field of magnetic flux thereat to attract said striker away from said diaphragm and toward said one pole when said coil is energized.

7. An improved horn as in claim 6, a first electrical contact mounted on said diaphragm and electrically connected therewith, and a second electrical contact electrically connected with said spring and mounted for movement with said striker, said spring normally urging said second contact into electrical engagement with said first contact.

8. An improved horn as in claim 5, said coil including a bobbin of electrically insulating material, said bobbin being mounted on said bracket and said bobbin, bracket, insulator means and housing having aligned passages, said bobbin having a shoulder formed around said passage therein and extending into said bracket passage, and fastener means extended through said passages and between said bobbin and housing to mount said bobbin, bracket and insulator means in said housing, said bobbin shoulder electrically insulating said fastener from said bracket whereby said bracket is maintained electrically insulated from said housing.

9. An improved horn as in claim 1, means external of said housing for directly connecting one of said coil terminals with said mounting means terminal and for selectively applying a source of d.c. voltage across said housing and said other coil terminal to operate said horn when said voltage is applied.

10. An improved horn as in claim 9, said means for connecting and applying including a substrate, said horn being mounted on said substrate and said substrate having circuitry thereon for directly connecting said one coil terminal with said mounting means terminal and for selectively applying said source of d.c. voltage across said housing and said other coil terminal, whereby when said voltage is applied said voltage is connected across said coil terminals through a circuit including said housing, diaphragm, striker, striker mounting means, and said circuitry for directly connecting said striker mounting means terminal with said one coil terminal, to energize said coil and attract said striker away from said diaphragm, said striker upon moving away from said diaphragm breaking said electrical connection therebetween and interrupting said voltage across said coil to deenergize said coil, said striker then returning strikingly against said diaphragm to generate noise and to reestablish said electrical connection therebetween, whereupon said cycle of operation is repeated for as long as said voltage is applied.

* * * * *